US006560345B1

(12) United States Patent
Hachisuka

(10) Patent No.: US 6,560,345 B1
(45) Date of Patent: May 6, 2003

(54) MICROPHONE

(76) Inventor: Yasuhiro Hachisuka, 19-7, Shiratori 3-chome, Katsushika-ku, Tokyo (JP)

( * ) Notice: Subject to any disclaimer, the term of this patent is extended or adjusted under 35 U.S.C. 154(b) by 231 days.

(21) Appl. No.: 09/698,316

(22) Filed: Oct. 27, 2000

(30) Foreign Application Priority Data

Feb. 29, 2000 (JP) ..... 2000-052797

(51) Int. Cl.[7] ..... H04R 17/02
(52) U.S. Cl. ..... 381/369; 381/354
(58) Field of Search ..... 381/345, 346, 381/347, 348, 349, 350, 355, 359, 360, 368, 369, 170, 189, FOR 147, FOR 148

(56) References Cited

U.S. PATENT DOCUMENTS 5,359,157 A * 10/1994 Liu ..... 181/129

FOREIGN PATENT DOCUMENTS

| | | | |
|---|---|---|---|
| GB | 2059715 A * | 4/1981 | ..... H04R/1/06 |
| JP | 1979-155820 | 12/1979 | |
| JP | 1981-27598 | 3/1981 | |
| JP | 1981-52993 | 5/1981 | |
| JP | 1981-87998 | 7/1981 | |
| JP | 1982-119594 | 7/1982 | |
| JP | 1983-36879 | 8/1983 | |
| JP | 1993-191884 | 7/1993 | |
| JP | 1994-90491 | 3/1994 | |
| JP | 1996-322096 | 12/1996 | |

OTHER PUBLICATIONS

Chandler, et al. UK Patent Application Publication, Granular Flow Sensing and Switching Device. published Apr. 6, 1977.*

Hachisuka, Yasuhiro. Japanese Published Unexamined Patent Application No. 55–073195. Published Nov. 27, 1978.*

* cited by examiner

*Primary Examiner*—Sinh Tran
*Assistant Examiner*—Brian Ensey
(74) *Attorney, Agent, or Firm*—Zito tlp; Joseph J. Zito

(57) ABSTRACT

The invention provides a close-talking type microphone which can shut a sound under a loud sound environment and does not make it hard or impossible for receivers to recognize a target sound due to a significant reduction of a quality of receiving the target sound. The microphone is provided with an outer casing having an open front surface, an inner casing having a front wall provided with a sound hole in a center portion, the front wall closing the front surface, having a space on a peripheral surface and a rear surface, and inserted to the outer casing, a sound pressure-electricity conversion unit fitted and held in the inner casing so as to direct a vibrating body toward the sound hole and a porous cap member covering the front surface of the front wall. The inner casing is made of a vibration isolating material, and the space is filled with a sound absorbing material constituted of a fiber laminated material.

5 Claims, 1 Drawing Sheet

MICROPHONE

BACKGROUND OF THE INVENTION

1. Field of the Invention

The present invention relates to a microphone capable of being used in a place with a loud sound, and more particularly to a close-talking type microphone excellent in a noise shutting function.

2. Description of the Prior Art

The microphone receives various kinds of noises and sounds depending on use environments and a quality of receiving a target sound is frequently reduced or the target sound can not be frequently recognized. Accordingly, various countermeasures have been considered so as to reduce or prevent mixing of the noise and sound into the target sound.

The countermeasures mentioned above can be broadly classified into countermeasures by electric means and countermeasures by mechanical means. The countermeasures by the electric means is structured such as to remove an electric signal component on the basis of the noise and sound from an electric signal output by converting vibrations such as a sound pressure or the like by means of the microphone. In the countermeasures by the electric means, a process circuit there for is required and two microphones are commonly used as disclosed in Japanese Patent Laid-Open Gazette Nos. 57-119594 and 5-191884. Accordingly, the structure is effective with respect to a microphone fixed and placed to a specific place but can not be applied to a microphone used by being moved to unspecified places, particularly, a close-talking type microphone.

The countermeasures by the mechanical means includes a structure having a main object of removing a so-called wind noise such as a flight noise, a pop noise and the like by placing an open cell foamed body between a vibrating body and a cap disposed in a front surface thereof, as disclosed in Japanese Unexamined Patent Laid-Open Gazette Nos. 54-155820, 55-73195, 56-87998 and 8-322096. Further, as disclosed in Japanese Patent Laid-Open Gazette Nos. 56-27598 and 56-52993, there is a structure having a main object of preventing a so-called vibration sound generated by a mechanical vibration from outside by holding a microphone unit having a vibration body and an electric conversion portion in a case with employing an elastic material or a magnetic material in a floating state. Further, as disclosed in Japanese Patent Laid-Open Gazette No. 6-90491, there is a structure having a main object of shutting a loud sound by improving a close attaching property with respect to a close attaching type microphone such as a throat microphone, an ear-hole microphone, a bone conduction microphone or the like.

The structure in which the mechanical means is applied to the microphone itself as the sound countermeasure has an advantage that the microphone itself can be moved to an unspecified place and can be optionally used. However, in a place where a sound is too loud to normally talk or communicate over the telephone, in particular, a sound having a frequency and a sound pressure level equal to or more than those of a human voice is generated, such as a plant under operation, a construction field, a flying airplane, a running vehicle or the like, these loud sounds can not be shut by the structure mentioned above having the main object of preventing the wind noise and the vibration noise. Further, in the case of applying the structure of the close attaching type microphone to the close-talking type microphone to which the mouth is moved in close to talk, the structure has no effect against the loud sound.

SUMMARY OF THE INVENTION

An object of the present invention is to provide a close-talking type microphone which can shut a sound under a loud sound environment, does not make it hard or impossible for receivers to recognize a target sound due to a significant reduction of a quality of receiving the target sound, and does not accompany the problems mentioned above.

In order to achieve the problems mentioned above, in accordance with the present invention, there is provided a microphone comprising:

an outer casing having an open front surface;

an inner casing having a front wall provided with a sound hole in a center portion, the front wall closing the front surface, having a space on a peripheral surface and a rear surface, and inserted to the outer casing;

a sound pressure-electricity conversion unit fitted and held in the inner casing so as to direct a vibrating body toward the sound hole; and a porous cap member covering the front surface of the front wall, wherein the inner casing is made of a vibration isolating material, and the space is filled with a sound absorbing material constituted of a fiber laminated material.

The sound absorbing material charged in the space between the outer casing and the inner casing so as to surround the peripheral side surface and the rear surface of the sound pressure-electricity conversion unit has a significantly complex labyrinthine gap in comparison with the open cell foamed body, and irregularly disperses the sound pressure corresponding to a wave motion of the air so as to absorb. Further, the inner casing made of the vibration isolating material damps a vibration generated by the sound pressure passing through the sound absorbing material. Accordingly, it is possible to widely reduce or prevent the noise and the sound entering from the periphery through the outer casing from vibrating the vibrating body.

Further, the noise and the sound from the forward direction is shut by a speaker and does not reach the front surface of the microphone, so that the noise and the sound except the target sound hardly passes through the sound hole by speaking with positioning the mouth close to the cap member. Further, the front wall of the inner casing serves to damp the vibration generated by the noise and the sound going to enter from the front oblique direction, and in the case that the open cell foamed body is provided between the front wall and the sound pressure-electricity conversion unit or (and) the cap member, the shutting function of the noise and sound is more improved.

In this case, a natural or synthetic rubber is preferable for the vibration isolating material for forming the inner casing, and a glass wool is optimum for the fiber laminated material for forming the sound absorbing material.

DESCRIPTION OF THE PREFERRED EMBODIMENT

Figure 1:
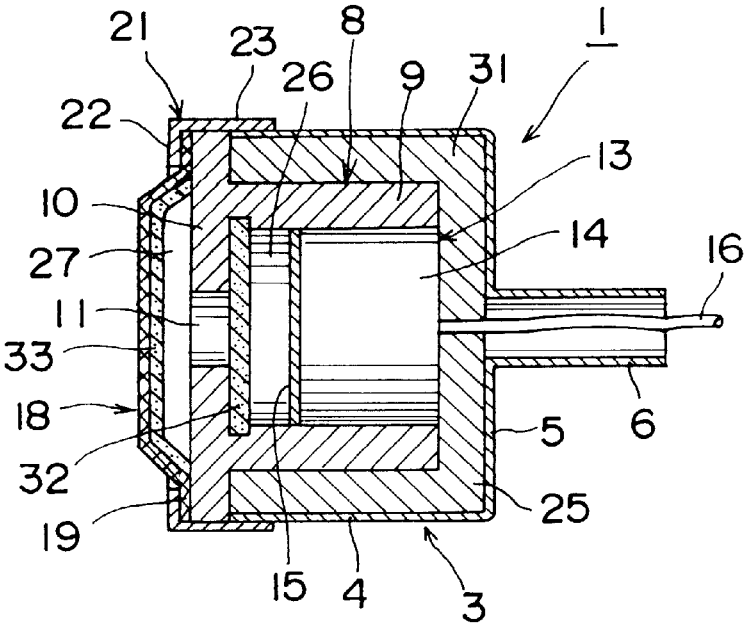
FIG. 1 is a vertical cross sectional view showing an embodiment in accordance with the present invention.
Figure 2:
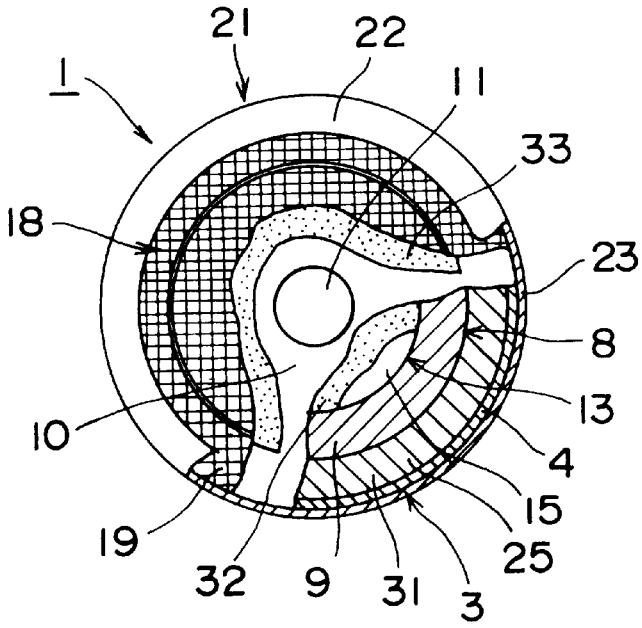
FIG. 2 is a view showing a portion obtained by partly cutting away and viewing FIG. 1 from a left side.

A description will be given of an embodiment in accordance with the present invention with reference to the accompanying drawings. A microphone of the present invention denoted by reference numeral 1 is provided with an outer casing 3 and an inner casing 8. The outer casing 3 is formed of a metal or a hard synthetic resin, has a cylindrical barrel wall 4, a bottom wall 5 having one closed end surface and a pipe member 6 fixed to a center portion of the bottom wall 5 in such a manner as to be protruded outward, and is formed to be thin as a whole.

The inner casing 8 is formed of a vibration isolating material, generally a natural rubber or a synthetic rubber, has a cylindrical main body wall 9 with shorter length and diameter than those of the barrel wall 4 and a front wall 10 having one closed end surface, and is formed to be thicker than the outer casing 3 as a whole, especially the main body wall 9 is formed to be further thicker than the front wall 10. The front wall 10 is a disc having a diameter equal to an outer diameter of the barrel wall 4 of the outer casing 3 and is provided with a sound hole 11 in a center portion thereof. The sound hole 11 has a hole diameter set depending on a use environment of the microphone and a range of an output impedance of a vibrating body 15 mentioned below, and is generally structured such that one sound hole having a range between 1 and 10 mm is provided, however, two or more holes may be provided.

A sound pressure-electricity conversion unit 13 corresponding to a main element of the microphone 1 is made of a hard synthetic resin and is structured such that an outer peripheral edge portion of a vibrating body 15 constituted of a vibrating plate or a vibrating membrane is bonded to one end surface of a cylindrical housing 14 having an outer diameter equal to an inner diameter of the main body wall 9 and a movable coil for converting a speed or a displacement of the vibrating body 15 due to the sound pressure into a change of a voltage or a current and the like are contained within the housing 14. The sound pressure-electricity converting unit 13 is connected to a circuit such as a filter, an amplifier or the like by a conductor wire 16 extending through the pipe member 6.

The pipe member 6 is employed for being fitted to a front end of an arm or a column so as to hold the microphone at a desired position in addition to protecting the conductor wire 16.

The cap member 18 is formed of a metal net or a punched porous metal sheet in the same manner as the generally employed structure, has a diameter equal to the outer diameter of the outer casing 3, is structured such that an outer peripheral edge portion 19 is a little retracted to a back surface side, and is formed in a shallow plate shape as a whole.

The sound pressure-electricity conversion unit 13 is fitted to the main body wall 9 from the open end surface side at the rearward portion so as to be held with directing the vibrating body 15 toward the sound hole 11. The inner casing 8 is concentrically arranged with the outer casing 3 by inserting the main body wall 9 to the barrel wall 4 of the outer casing 3 from the open end surface side until the outer peripheral edge portion of the front wall 10 contacts to the end edge of the barrel wall 4. The cap member 18 is arranged on the front surface of the front wall 10 with contacting the outer peripheral edge portion 19.

Then, the outer casing 3, the inner casing 8 and the cap member 18 are fixed to each other by fitting an annular pressing member 21 to the contacting portion from the front surface, fixing an inward flange portion 22 thereof to the outer peripheral edge portion 19 of the cap member 18 and closely fixing a skirt portion 23 to the outer peripheral surface of the barrel wall 4. It is possible to dissolve three parts 3, 8 and 18 mentioned above by pulling out the pressing member 21, and it is possible to reassemble.

The inner casing 8 is structured such that the outer peripheral surface of the main body wall 9 and the rear wall of the sound pressure-electricity converting unit 13 are inserted to the outer casing 3 with forming a space 25 between the barrel wall 4 and the bottom wall 5, and the space portion of the outer peripheral surface extends to a forward area from the front surface of the sound pressure-electricity conversion unit 13. The space 25 is filled with a sound absorbing material 31 constituted of a fiber laminated material. The sound absorbing material 31 can employ a natural fiber such as a cotton or the like, a synthetic fiber such as a polyurethane or the like, a glass wool and a rock wool, however, in view of a sound absorbing performance, the glass wool is optimum. Further, it is preferable that the fiber laminated material is charged into the space 25 in a state of being a little compressed so as to form a labyrinthine gap in which complex narrow passages are combined with each other.

Longitudinal narrow spaces 26 and 27 are respectively formed between the front wall 10 of the inner casing 8 and the sound pressure-electricity converting unit 13 and between the front wall 10 and the cap member 18. Open cell foamed bodies 32 and 33 made of a polyurethane sponge or the like and formed in a thin disc shape are charged into the spaces 26 and 27.

When talking in a state of positioning the mouth to the front surface of the cap member 18, the sound applies the sound pressure to the vibrating body 15 through the cap member 18, the foamed body 33, the sound hole 11 and the foamed body 32. At this time, two foamed bodies 33 and 32 vertically arranged with having an interval therebetween serve to prevent the wind noise. Further, the front foamed body 33 catches a splash of saliva scattered from the mouth at a time of speaking so as to prevent the splash from entering into the microphone 1.

Since the face of the speaker is close to the front surface when the microphone 1 is placed under the loud sound environment, the sound pressure from the front and the oblique front is shut by the speaker. Further, since the sound pressure entering into the gap between the face of the speaker and the cap member 18 enters into the cap member 18 at a large incident angle, most of the sound pressure passes by the surface.

When the sound pressure of the loud sound acts on the barrel wall 4 and the bottom wall 5 in the outer casing 3, the wall portions thereof formed of the thin metal or the synthetic resin vibrate so as to transmit the sound pressure to the space 25 substantially as it is. Since the sound absorbing material 31 charged into the space 25 has a complex labyrinthine gap, the sound pressure is irregularly dispersed without straightly transmitting so as to be damped and absorbed. Further, since the inner casing 8 is made of the vibration isolating material, the main body wall 9 mainly damps the vibration generated by the sound pressure passing through the sound absorbing material 31.

Since the front wall 10 of the inner casing 8 covers the whole of the open front surface of the outer case 3, it is possible to catch and damp the sound pressure applied from the oblique front in various directions, and the foamed body 32 serves to assist damping.

As is apparent from the description mentioned above, in accordance with the present invention, the target sound corresponding to the voice of the speaker applies the sound pressure to the center portion of the vibrating body through the sound hole having a small area, it is possible to shut most of the sound pressure generated by the other noise and sound so as to prevent the quality of receiving the target sound from being reduced, and it is possible to clearly transmit the voice of the speaker under the loud sound environment to the receivers.

What is claimed is:

1. A microphone comprising:

an outer casing having an open front surface;

an inner casing having a front wall provided with a sound hole in a center portion, said front wall closing said front surface, having a space on a peripheral surface and a rear surface, and inserted to said outer casing;

a sound pressure-electricity conversion unit fitted and held in said inner casing so as to direct a vibrating body toward said sound hole; and a porous cap member covering the front surface of said front wall, wherein said inner casing is made of a vibration isolating material, and the space is filled with a sound absorbing material constituted of a fiber laminated material.

2. A microphone as claimed in claim 1, wherein an open cell foamed body is placed between said front wall and the sound pressure-electricity conversion unit.

3. A microphone as claimed in claim 1, wherein an open cell foamed body is placed between said front wall and the cap member.

4. A microphone as claimed in claim 1, wherein the vibration isolating material forming said inner casing is a rubber.

5. A microphone as claimed in claim 1, wherein the fiber laminated material forming said sound absorbing material is a glass wool.

* * * * *